United States Patent [19]

Christian

[11] 4,267,623

[45] May 19, 1981

[54] CASKET ORNAMENT STRUCTURE

[76] Inventor: Francis R. Christian, 411 Ashland Ave., River Forest, Ill. 60305

[21] Appl. No.: 76,202

[22] Filed: Sep. 17, 1979

Related U.S. Application Data

[63] Continuation of Ser. No. 871,450, Jan. 23, 1978, abandoned.

[51] Int. Cl.[3] ..... A61G 17/04

[52] U.S. Cl. ..... 27/2; 16/126

[58] Field of Search ..... 27/1, 2, 4, 5, 6, 7, 27/8; 16/2, 3, 126; 428/542; D99/11, 15, 16; D8/350; 292/357; 312/204, 320; 156/293; 70/452; 40/20, 26, 124.5

[56] References Cited

U.S. PATENT DOCUMENTS

| | | | |
|---|---|---|---|
| D. 8,791 | 11/1875 | Smith | D99/16 |
| 420,854 | 2/1890 | Atkins | 70/452 |
| 993,996 | 5/1911 | Holstein | 27/2 |
| 1,378,179 | 5/1921 | Luick | 16/126 |
| 1,779,488 | 10/1930 | Patterson | 27/2 |
| 1,819,611 | 8/1931 | Martin | 16/126 |
| 2,028,071 | 1/1936 | Kemper | 16/126 |
| 3,025,624 | 3/1962 | Harrell | 27/1 X |
| 3,162,411 | 12/1964 | Duggan | 16/2X |
| 3,775,808 | 12/1973 | Little | 312/204 |
| 3,871,937 | 3/1975 | Hollingsead et al. | 156/293 X |
| 3,937,537 | 2/1976 | Dietterich | 312/204 |
| 4,077,096 | 3/1978 | Christian | 27/2 |

FOREIGN PATENT DOCUMENTS

| | | | |
|---|---|---|---|
| 508197 | 1/1955 | Italy | 292/357 |

*Primary Examiner*—James R. Feyrer

*Attorney, Agent, or Firm*—Kinzer, Plyer, Dorn & McEachran

[57] ABSTRACT

This invention is concerned with a casket ornament structure and more specifically, relates to a handle mounting ornament which can be used to decorate the structural members of a casket handle.

6 Claims, 2 Drawing Figures

CASKET ORNAMENT STRUCTURE

This is a continuation of application Ser. No. 871,450, filed Jan. 23, 1978 now abandoned.

SUMMARY OF THE INVENTION

This invention relates to decorative elements added to the exterior structural members of a casket to enhance its appearance. Specifically, the invention is concerned with decorating the brackets to which the casket handles are attached.

A primary object of this invention is a decorative element having a standard-sized support portion adapted to attach to the casket handle structure the variable configuration of any desired medallion, symbol or commemorative ornament.

Another object is a decorative element which can be incorporated in a structural member of a casket handle without interferring with the function of such member.

Another object is a decorative element which is inexpensive to manufacture.

Another object is a decorative element which can be easily applied to the casket handle structure subsequent to the assembly of that handle structure, thus permitting individual selection of a wide variety of decorative motifs which need not be applied at the point of manufacture.

Other objects will appear from time to time in the ensuing specification and drawings.

Accordingly, the invention is directed to a decorative insert which is set in an opening in a handle mounting bracket. The bracket is dish-shaped, outwardly convex and is attached to one of the casket walls. The decorative insert has a lip engaging the rim of the bracket opening with inwardly extending surfaces extending from the lip to form a skirt. Tabs are attached to the skirt which engage the rim of the bracket opening in such a manner as to hold the insert in place. An ornament is located between the surfaces of the skirt and is attached thereto to present a decorative exterior appearance.

DESCRIPTION OF THE PREFERRED EMBODIMENT

Figures 1, 2:
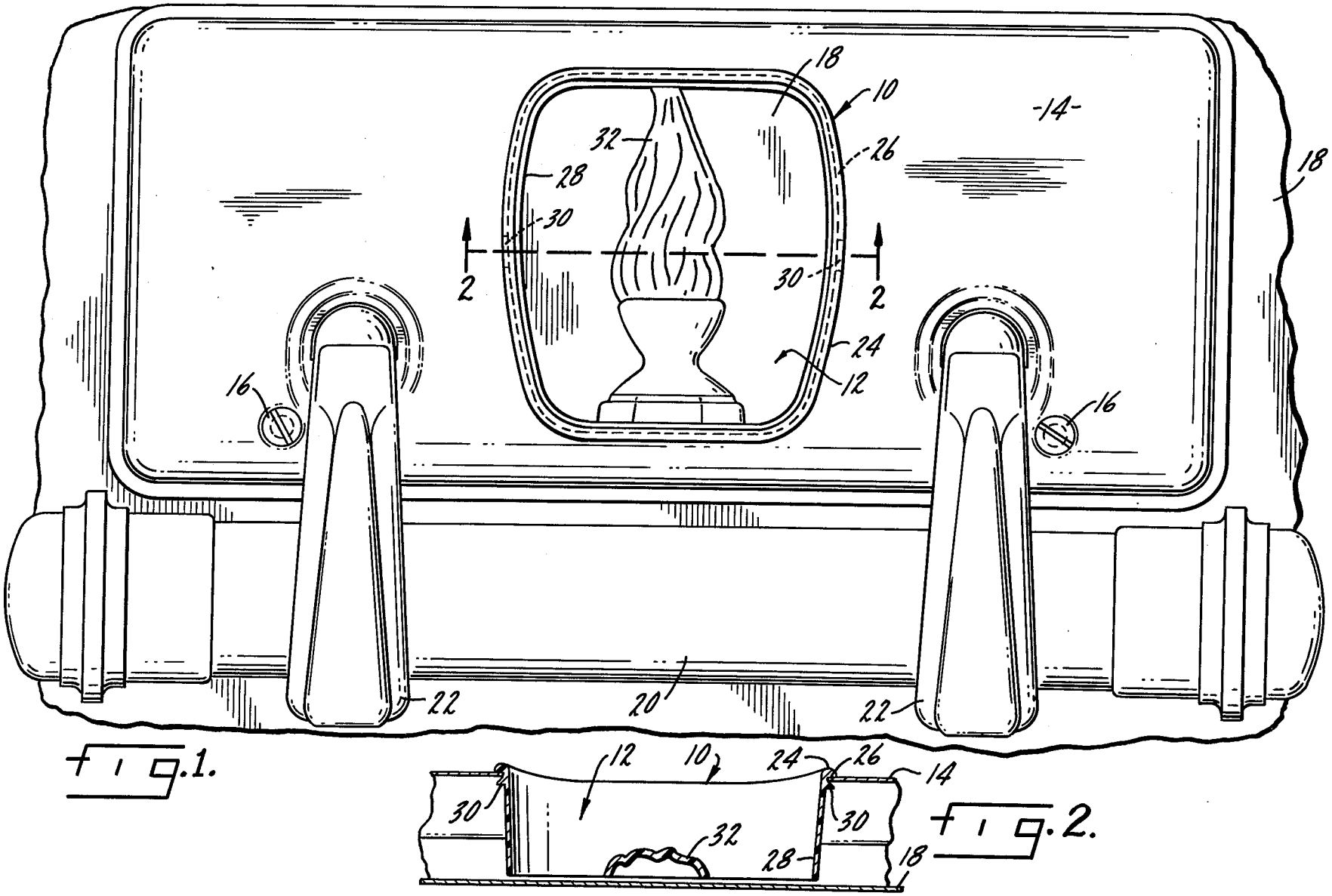
FIG. 1 is a front view of the casket handle, mounting bracket and decorative insert.
FIG. 2 is a section along lines 2—2 of FIG. 1.

FIG. 1 shows the casket handle structure in which this invention is used. The decorative insert is shown generally at 10. It fits in an opening 12 in a handle mounting bracket 14. This bracket is attached by screws 16 to a side or end wall 18 of the casket structure. The bracket 14 is dish-shaped, being outwardly convex and may be considered to be a stamped steel part that is cupped or concaved inwardly so that there is a space or void between its surface and the wall of the casket.

The handle includes a bar 20 which is suitably connected to legs 22 which may have a hollow or generally open interior and a decorative exterior. The legs 22 are pivotally connected to the bracket 14. An arrangement for effecting this connection is shown in U.S. patent application of Frances R. Christian, Ser. No. 747,959, allowed Sept. 22, 1977.

The decorative insert 10 fits in the void between the handle bracket face and the casket wall. The insert has a lip 24 which engages the rim 26 of the opening 12 in the bracket. The lip may have a decorative figure molded in its outer surface to enhance its appearance. The lip is integrally formed on the top edges of inwardly extending surfaces which form a skirt 28. In a preferred embodiment, the lip and skirt extend all the way around the perimeter of the opening 12. The skirt extends inwardly to a point near the casket wall 18. Formed on the outside of the skirt, near the top edge, are tabs 30 which engage the bottom surface of the rim 26 to hold the insert in place. The lip 24 and tab 30 engage the thickness of the rim 26 between them to lock the insert in place. The insert is made from a flexible plastic material which permits it to be flexed upon insertion into the opening thus allowing the tabs 30 to clear the rim 26 upon insertion. Releasing the flexing pressure allows the skirt to return to its normal width thereby bringing the tabs 30 into their holding position on the underside of the rim 26. In the form shown, the insert is somewhat elongated in a vertical direction and the tabs are placed on the longer sides which have more flexibility. But it might be otherwise.

The lip 24, skirt 28 and tabs 30 collectively form a support means for an ornament 32. The ornament 32 is disposed between the surfaces of the skirt 28 and is attached thereto. Preferably, the ornament is molded into the skirt so the insert comprises a single piece. The ornament can be of any desired shape or configuration according to the needs of the particular use. Any appropriate ornament can be attached to the surfaces of the skirt without changing the mold blocks needed for the skirt, tabs and lip. Thus, the standard-sized support means receives a variably-sized ornament. This allows a wide variety of decorative inserts to be manufactured without changing the opening 12 in the stamped mounting bracket 14 and without changing the mold configuration for the support portion of the insert. The only alteration required is in the mold for the ornament portion of the insert.

Also, since the insert can be applied to the handle bracket after installation of the bracket on the casket, selection of an ornament can await the choice of the particular use. The decorative insert of the present invention can be used in conjunction with the lug or covering described in the above referred to patent of Frances R. Christian. This covering fits over the outer surface of the bracket 14 with cutout portions for the opening 12 and legs 22. Another possible finishing treatment is to cover the bracket and insert with a thin metallic coating. Copper, for example, can be used as a coating which gives the bracket and insert the appearance of being a single piece.

While the opening 12 of the handle mounting bracket is shown to be generally rectangular with rounded corners, this opening could be any desired shape. Altering the shape of the opening could dictate a change in the position or number of the tabs 30. The tabs should be located so as to take advantage of the maximum flexibility of the insert. This position will depend on the shape of the insert and the configuration of the ornament. For example, if the ornament is attached to all four sides of the skirt, the best location for the tabs would be diagonally opposite corners of the insert. Also, with some configurations, three or four tabs might be preferred to assure the insert is locked in place.

While the preferred form of the invention has been shown and described, it should be understood that suitable modifications may be made without departing from the invention's fundamental theme. For example, the insert could be used in a bracket which, rather than serving as a handle mounting, has a purely decorative purpose.

The embodiments of the invention in which an exclusive property or privilege is claimed are defined as follows:

1. For use with a casket structure having a casket body closed on the bottom with four upstanding walls, a decorative mounting adapted to be mounted on the walls of such a casket, including a dish-shaped, outwardly convex unitary bracket adapted to be attached to the side walls of such a casket, an opening in the bracket with the edges thereof defining a rim, a decorative insert releasably positioned in the bracket opening and having a peripheral framing circumferential flexible skirt set in and conforming to the bracket opening so as to engage the rim, an ornament astride and mounted in the flexible skirt and visible from the outside, the ornament joining the skirt in a limited number of spaced locations so that the skirt can be easily flexed in areas where the ornament is not joined to it, and a releasable interlock between the insert skirt and the rim of the opening responsive to flexing of the skirt in the plane of the opening in the areas where the ornament is not joined to it to release or hold the insert in the bracket opening.

2. The structure of claim 1 wherein the support means comprises:

a lip engaging the rim of the bracket opening, a skirt formed by inwardly extending surfaces depending from the lip, tabs attached to the skirt so as to engage the rim of the bracket opening on the side opposite the lip so the lip and tabs lock the rim therebetween maintaining the insert in a fixed location with the ornament disposed between the surfaces of the skirt and attached thereto to present a decorative exterior appearance.

3. The structure of claim 1 wherein the decorative insert is a unitary piece molded from a resilient plastic material.

4. The structure of claim 1 wherein the lip of the insert has a decorative design on it to further enhance the appearance of the handle mounting bracket.

5. The structure of claim 1 wherein the lip and skirt extend all the way around the perimeter of the bracket opening.

6. The structure of claim 1 wherein the bracket has attached thereto a handle for use in lifting the casket.

* * * * *